US010328551B2

(12) United States Patent
Kaiser

(10) Patent No.: US 10,328,551 B2
(45) Date of Patent: Jun. 25, 2019

(54) CLAMPING DEVICE

(71) Applicant: DE-STA-CO Europe GmbH, Oberursel (DE)

(72) Inventor: Richard Kaiser, Bad Homburg (DE)

(73) Assignee: DE-STA-CO Europe GmbH, Oberursel (DE)

( * ) Notice: Subject to any disclaimer, the term of this patent is extended or adjusted under 35 U.S.C. 154(b) by 288 days.

(21) Appl. No.: 15/426,250

(22) Filed: Feb. 7, 2017

(65) Prior Publication Data

US 2017/0144274 A1 May 25, 2017

Related U.S. Application Data

(63) Continuation of application No. PCT/DE2015/100325, filed on Aug. 3, 2015.

(30) Foreign Application Priority Data

Aug. 8, 2014 (DE) ..... 10 2014 111 344

(51) Int. Cl.
*B25B 5/06* (2006.01)
*B25B 5/08* (2006.01)
*B25B 5/12* (2006.01)

(52) U.S. Cl.
CPC ..... *B25B 5/122* (2013.01); *B25B 5/064* (2013.01); *B25B 5/087* (2013.01)

(58) Field of Classification Search
CPC .. B25B 5/064; B25B 5/08; B25B 5/12; B25B 5/122; B25B 5/00; B25B 5/06; B25B 5/16
See application file for complete search history.

(56) References Cited

U.S. PATENT DOCUMENTS 5,215,295 A * 6/1993 Hoover ..... B25B 5/122 269/31
5,575,462 A * 11/1996 Blatt ..... B25B 5/122 269/32
5,704,600 A * 1/1998 Robinson ..... B25B 5/122 269/228
5,829,112 A * 11/1998 Blatt ..... B25B 1/2484 29/416
5,967,502 A * 10/1999 Dykstra ..... B25B 5/122 269/228
5,996,984 A * 12/1999 Takahashi ..... B25B 5/16 269/228

(Continued)

FOREIGN PATENT DOCUMENTS

EP 2 511 047 10/2012
WO WO2008/089145 7/2008

*Primary Examiner* — Tyrone V Hall, Jr.
(74) *Attorney, Agent, or Firm* — Harness, Dickey & Pierce, P.L.C.

(57) ABSTRACT

A clamping device has a rotatably mounted clamping shaft (2), a clamping element (1), and a control mechanism (3). The clamping shaft (2) is formed from an inner shaft (2.1) and an outer shaft (2.2) that receives the inner shaft (2.1). The outer shaft is connected to the control mechanism (3) to pivot the clamping shaft (2), via a lever arm (5). The inner shaft (2.1) is rotationally connected conjointly to the clamping element (1). The inner shaft (2.1) is fixed in position relative to the outer shaft (2.2) by an adjustment element (4) connected to the inner shaft (2.1).

12 Claims, 4 Drawing Sheets

(56) References Cited

U.S. PATENT DOCUMENTS 6,059,277 A * 5/2000 Sawdon ..... B25B 5/122 269/24
6,199,846 B1 * 3/2001 Crorey ..... B23K 37/0435 269/233
6,199,847 B1 * 3/2001 Fukui ..... B25B 5/122 269/32
6,338,476 B1 * 1/2002 Takahashi ..... B25B 5/122 269/228
6,416,045 B1 * 7/2002 Morroney ..... B25B 5/122 269/228
6,565,074 B1 * 5/2003 Wheeler ..... B25B 5/122 269/228
6,880,816 B1 * 4/2005 Wheeler ..... B25B 5/122 269/32
6,997,447 B2 * 2/2006 Fukui ..... B25B 5/122 269/32
8,382,083 B2 * 2/2013 Martin ..... B25B 5/087 269/239
8,740,203 B2 * 6/2014 Takahashi ..... B25B 5/122 269/228
2002/0063371 A1 * 5/2002 Takahashi ..... B25B 5/087 269/32
2002/0158394 A1 * 10/2002 Sawdon ..... B25B 5/122 269/32
2002/0190455 A1 * 12/2002 Sawdon ..... B25B 5/122 269/32
2002/0195761 A1 * 12/2002 Dellach ..... B25B 5/122 269/32
2004/0046299 A1 * 3/2004 Migliori ..... B25B 5/12 269/32
2009/0283948 A1 * 11/2009 Fukui ..... B25B 5/122 269/32
2010/0044942 A1 * 2/2010 Tamai ..... B25B 5/122 269/32
2012/0272782 A1 * 11/2012 Kaiser ..... B25B 5/122 74/519

* cited by examiner

CLAMPING DEVICE

CROSS-REFERENCE TO RELATED APPLICATIONS

This application is a continuation of International Application No. PCT/DE2015/100325, filed Aug. 3, 2015, which claims priority to German Application No. 102014111344.6, filed Aug. 8, 2014. The disclosures of the above applications are incorporating herein by reference.

FIELD

The disclosure relates to a clamping device with a rotatably mounted clamping shaft and, more particularly, to a clamping shaft with an inner and outer shaft connected rotationally conjointly to one another with an adjustment element fixing the inner shaft in position relative to the outer shaft.

BACKGROUND

A clamping device, in particular a so-called toggle lever clamping device, is known from patent document DE 10 2011 018 987 A1. This clamping device has a rotatably mounted clamping shaft that is rotationally connected conjointly to a clamping element. A control mechanism is operatively connected to the clamping shaft. The control mechanism converts a linear drive movement into a rotational movement of the clamping shaft. The clamping shaft is formed from an inner shaft and from an outer shaft. The outer shaft receives the inner shaft and is connected to the control mechanism. A lever arm is arranged on the outer shaft to pivot the clamping shaft. In this case, the clamping element is rotationally connected conjointly to the outer shaft. The inner shaft is connected to a hand lever. The clamping device can be released from a top dead center position of the control mechanism, formed as a toggle lever mechanism, in a simple manner.

The present disclosure is based on the object of improving a clamping device of the above-mentioned type. In particular, a toggle lever clamping device can compensate for tolerances in the component size in response to the clamping of the components.

For the sake of completeness, reference is also made to patent document U.S. Pat. No. 8,382,083 B2. Aside from a kinematics, it is designed very differently. It differs from the clamping device, according to the disclosure, in that a lever arm to pivot the clamping shaft is not provided on the outer shaft in the case. In fact, the pivoting of the clamping shaft is realized via a gear drive in the case.

The object is solved by a clamping device with a rotatably mounted clamping shaft connected to a clamping element. A control mechanism is operatively connected to the clamping shaft. The control mechanism converts linear drive movement into rotational movement of the shaft. The clamping shaft includes an inner shaft and an outer shaft. The outer shaft receives the inner shaft and is connected, via an outer circumferential lever arm, to the control mechanism. The inner shaft is rotationally connected conjointly to the clamping element. The inner shaft is displaceably mounted in the outer shaft. The inner shaft is mounted, in a rotationally conjoint fashion, radially within the outer shaft with respect to the main axis of rotation of the clamping shaft. An adjustment element fixes the inner shaft in a position relative to the outer shaft. The adjustment element is operatively connected to the inner shaft.

SUMMARY

According to the disclosure, the inner shaft is rotationally connected conjointly to the clamping element. The inner shaft is mounted in a displaceable but rotationally conjoint fashion radially within the outer shaft with respect to the main axis of rotation of the clamping shaft. An adjustment element fixes the inner shaft in a position relative to the outer shaft. The adjustment element is operatively connected to the inner shaft.

The displaceability of the inner shaft in the outer shaft can be utilized to compensate for component tolerances. The displacement of the inner shaft within the outer shaft is realized via the adjustment element. The adjustment element is connected to the control mechanism.

The adjustment element includes a cylindrical journal that is fixedly connected to the inner shaft. The cylindrical journal extends through a through opening on the outer shaft and is operatively connected to the control mechanism. The lever arm is articulatedly connected to an intermediate member. The journal, on its front side on its end that faces away from the inner shaft, includes a control face that interacts with a control cam on the intermediate member.

A centering element, formed as cylindrical pin, is oriented vertically to the main axis of rotation of the clamping shaft. The centering element is arranged between the inner shaft and the outer shaft. The centering element is fixedly connected to the inner shaft and is displaceably mounted in the outer shaft.

A resetting element, such as a compression spring, is arranged between the inner shaft and outer shaft.

The intermediate member is connected to an extension member in an articulated fashion. The extension member is connected to a linearly movable adjustment member in an articulated fashion. First and second guide elements, such as rollers, interact with a guide track in the clamp head housing. The first guide element is arranged on the extension member side end of the adjustment member. The second guide element is arranged on the intermediate member side end of the extension member.

The clamping device according to the disclosure, including its advantageous further developments according to the dependent claims, will be explained in more detail below by means of the graphic illustration of a preferred exemplary embodiment.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
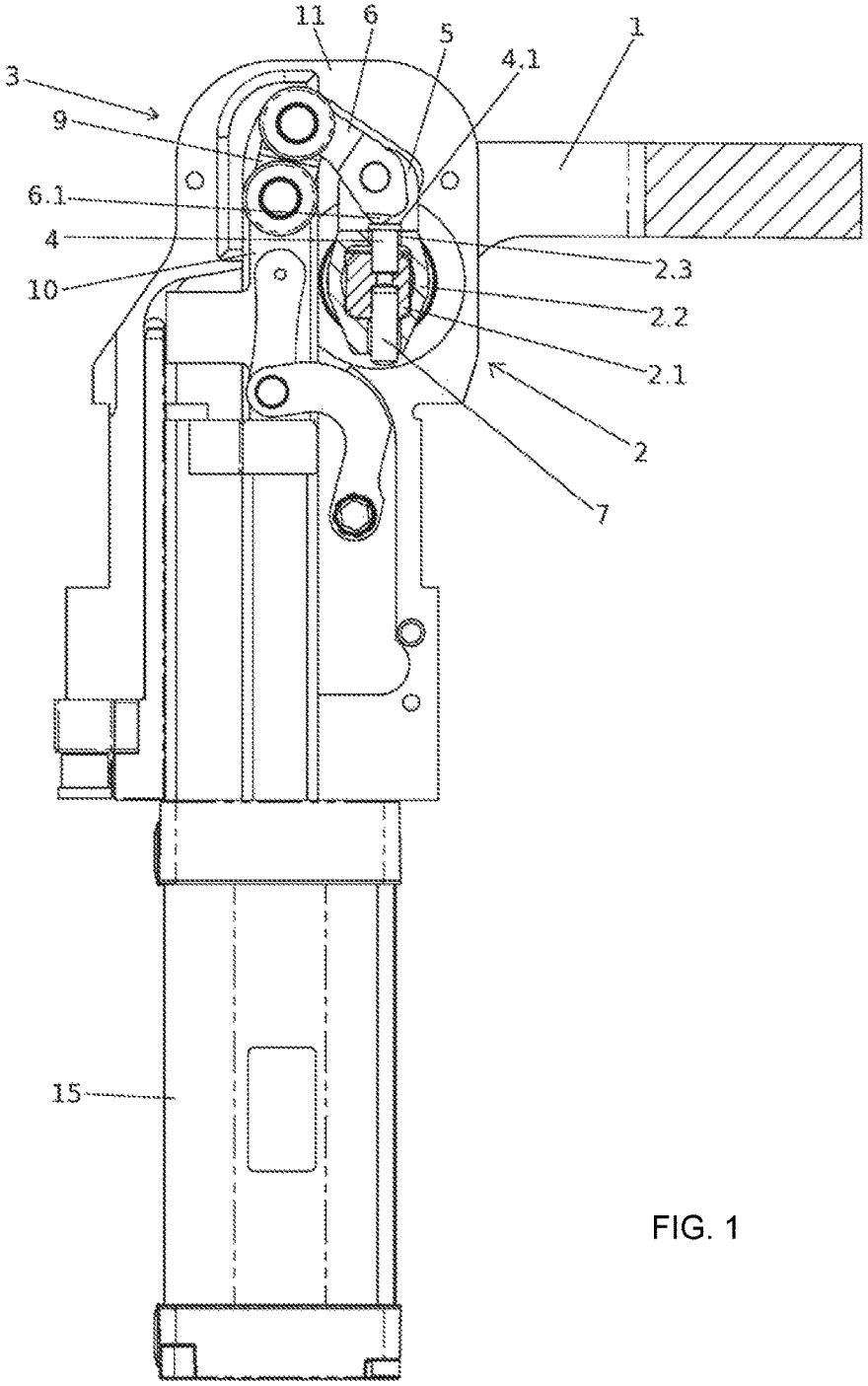
FIG. 1 is a partial cross-section view of the clamping device according to the disclosure in a maximal clamped position.

Hereafter, embodiments of the present disclosure will be specifically described with reference to the attached drawings.

The clamping device illustrated in the figures, in a known manner, has a rotatably mounted clamping shaft 2 and a control mechanism 3. The shaft 2 is rotationally connected conjointly to a clamping element 1, preferably a so-called clamping arm. The control mechanism 3 is operatively connected to the clamping shaft 2. The control mechanism 3 converts a linear drive movement into a rotational movement of the clamping shaft 2. The clamping shaft 2 includes an inner shaft 2.1 and an outer shaft 2.2. The outer shaft 2.2 receives the inner shaft 2.1. The outer shaft 2.2 is connected to the control mechanism 3. A lever arm 5 is arranged on the outer shaft 2.2 to pivot the clamping shaft 2.

The control mechanism 3 is in the form of a toggle lever mechanism. Optionally, it includes an intermediate member 6, an extension member 9 and/or an adjustment member 10. The adjustment member 10 is connected to a piston drive 15. The piston drive 15 is pneumatically operated. The control mechanism 3 is arranged in a clamp head housing 11. The piston drive 15 is connected to an adjustment member 10 which engages the clamp head housing 11.

The control mechanism 3 includes an additional mechanism for manually opening and closing the (toggle lever) clamping device. More particularly, see FIG. 2, the additional mechanism has a first link 18. The first link 18 is connected to the adjustment member 10 in an articulated fashion. A second link 19 is connected to the first link 18 in an articulated fashion. Also, the second link 19 is connected with the clamp head housing 11 in an articulated fashion. The second link 19 is formed so that it is capable of being rotated from outside the clamp head housing 11 by a lever (not illustrated separately).

The clamping device according to the disclosure includes the inner shaft 2.1 rotationally connected conjointly to the clamping element 1. The inner shaft 2.1 is displaceably mounted in the outer shaft. Also, in a rotationally conjoint fashion, the inner shaft 2.1 is radially positioned within the outer shaft 2.2 with respect to the main axis of rotation of the clamping shaft 2. The main axis is vertical to the image plane. An adjustment element 4 fixes the inner shaft 2.1 in a position relative to the outer shaft 2.2. The adjustment element 4 is operatively connected to the inner shaft 2.1.

The inner shaft 2.1 is preferably formed as a square shaft when viewed in cross section. The outer shaft 2.2 has a substantially rectangular receiving area 17 when viewed in cross section. The inner shaft 2.1 is received in the receiving area 17.

The adjustment element 4 is formed preferably as a cylindrical journal. The adjustment element 4 is fixedly connected to the inner shaft 2.1. The adjustment element 4 extends through a reach-through opening 2.3 on the outer shaft 2.2. The adjustment element 4 is operatively connected to the control mechanism 3.

The clamping device, according to the disclosure, includes the lever arm 5 connected to the intermediate member 6 in an articulated fashion. The adjustment member journal includes a contact surface 4.1 of its front side of its end that faces away from the inner shaft. The contact surface 4.1 interacts with a control cam 6.1 arranged on the intermediate member 6.

As will be explained in more detail below, these measures have the result that a pivoting of the intermediate member 6 leads to a displacement of the adjustment member journal 4 and thus of the inner shaft 2.1 within the outer shaft 2.2.

In addition, a centering element 7, formed as cylinder pin, is vertically oriented with respect to the main axis of rotation of the clamping shaft. The centering element 7 is arranged between the inner shaft 2.1 and the outer shaft 2.2. The centering element 7 is fixedly connected to the inner shaft 2.1. The centering pin 7 is displaceably mounted in the outer shaft 2.2.

Figure 6:
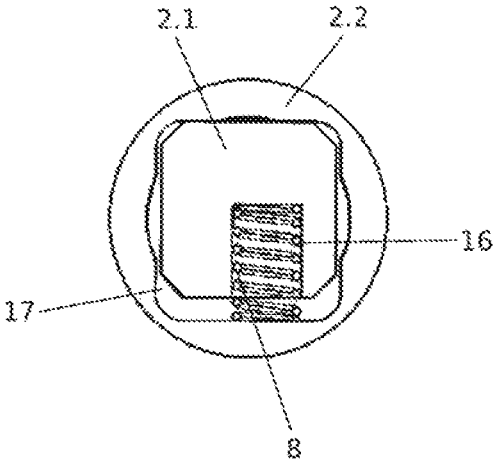
FIG. 6 is an enlarged cross-section view of the clamping shaft with the inner and outer shaft having an elastic resetting element in the clamped position according to FIG. 3.

A resetting element 8 (preferably elastic), such as a compression spring, is arranged between the inner shaft 2.1 and the outer shaft 2.2 (see FIG. 6). The resetting element 8 is partially arranged in a recess 16 on the inner shaft 2.1.

The intermediate member 6 is connected to an extension member 9 in an articulated fashion. The extension member 9, in turn, is articulatedly connected to the linearly movable adjustment member 10.

A first guide element 13, in the form of a roller, is arranged on the extension member-side end of the adjustment member 10. The guide element 13 interacts with a guide track 12 provided on the clamp head housing 11. A second guide element 14, in the form of a roller, is arranged on the intermediate member-side end of the extension member 9. The second guide element 14 also interacts with the guide track 12 provided on the clamp head housing 11.

The guide track 12, starting from the piston drive 15, initially has a straight guide track section 12.1. The guide track 12, on its end, which faces away from the piston drive 15, has a curved guide track section 12.2 (see FIG. 5). The first guide element 13 is thus guided exclusively in the straight guide track section 12.1. The second guide element 14 is guided either in the straight guide track section 12.1 or also in the curved guide track section 12.2.

Figure 4:
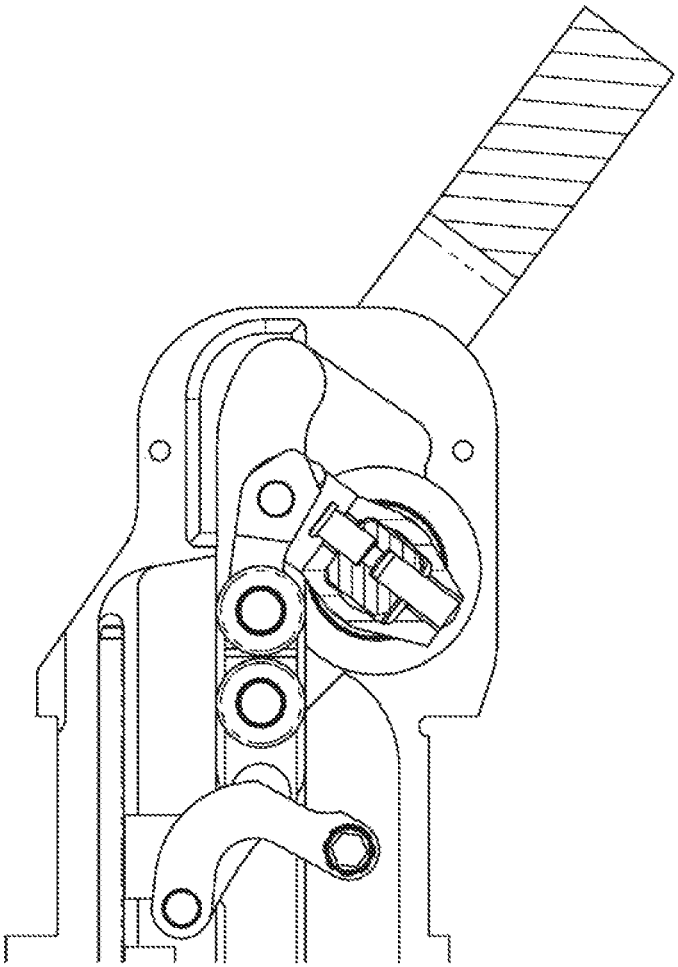
FIG. 4 is a cross-section view of the clamping device according to FIG. 1 in a half-open position.
Figure 5:
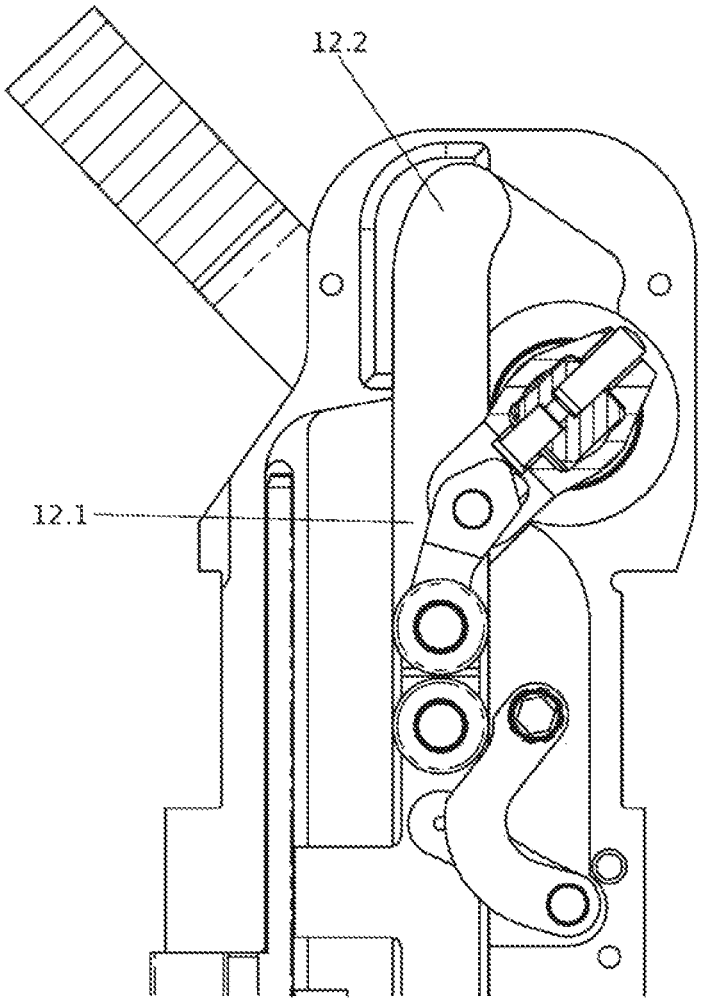
FIG. 5 is a cross-section view of the clamping device according to FIG. 1 in an open position.

The clamping device according to the disclosure operates as follows:

The starting point of the following description of the clamping device is in the open position according to FIG. 5. In this position, the adjustment member 10, driven by the piston drive 15, is in its lowest position. If the piston drive 15 is now operated, it leads to a vertically upwards movement of the adjustment member 10. FIG. 4 shows a position where the adjustment of the adjustment member 10 simultaneously leads to an adjustment of the extension member 9, of the intermediate member 6. Thus, this ultimately, in the known fashion, leads to a pivot movement of the clamping shaft 2 and of the clamping element 1.

In the open position (see FIG. 5), the control cam 6.1 according to the disclosure touches the contact surface 4.1. This circumstance, however, initially does not have any further significance in this control position. It is important, however, that the control cam 6.1 and the contact surface 4.1 do not touch one another any longer in the control position according to FIG. 4. This has the result that the inner shaft 2.1, due to the applied force of the resetting element 8, (see FIG. 5), moves in the direction of the lever arm 5 guided by the centering element 7. Incidentally, the centering elements 7 can also be provided several times across the length of the clamping shaft 2.

Figure 2:
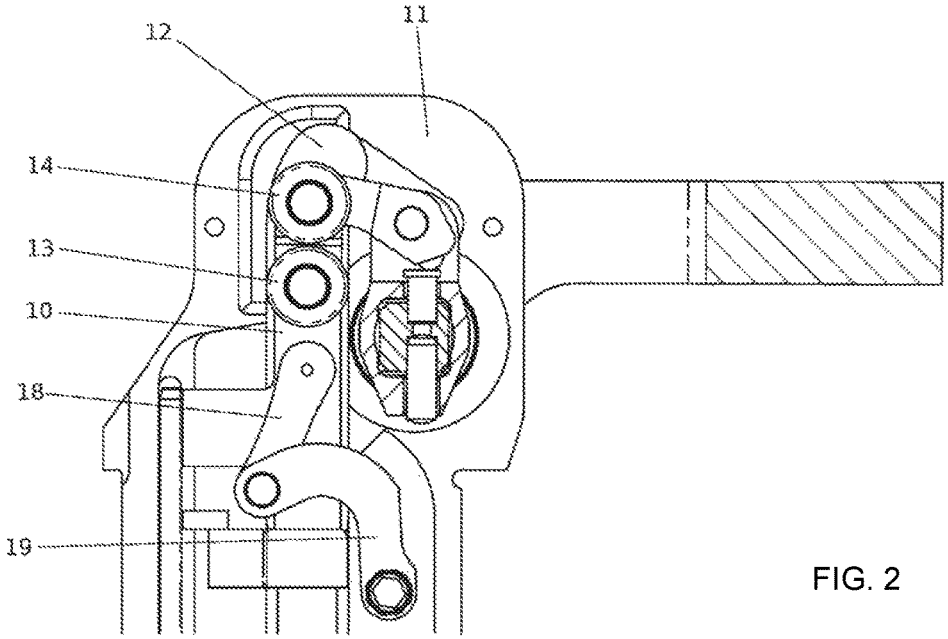
FIG. 2 is a cross-section view of the clamping device according to FIG. 1 prior to reaching the maximum clamped position.
Figure 3:
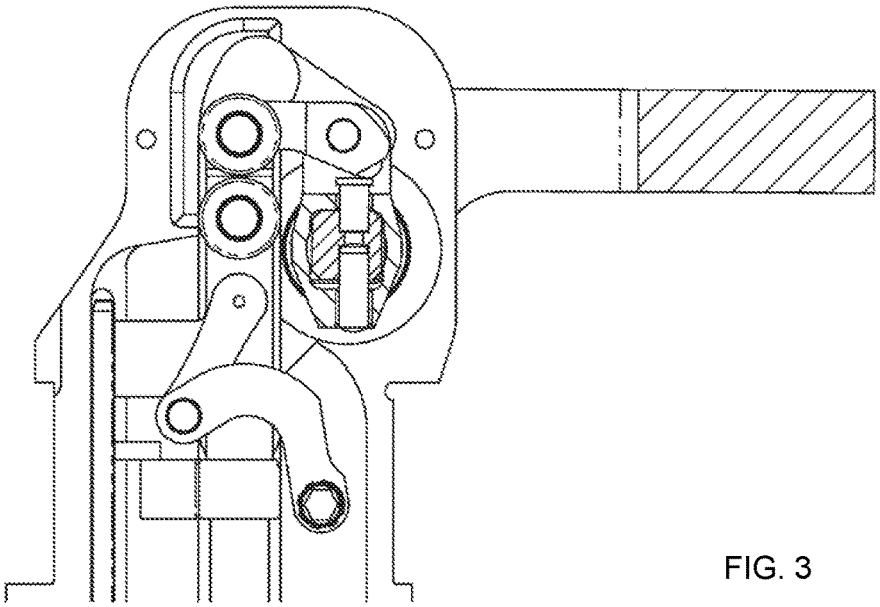
FIG. 3 is a cross-section view of the clamping device according to FIG. 1 at the beginning of the clamped position.

If the adjustment member 10 is now displaced farther to the top of the housing 11 by the piston drive 15, the position initially illustrated in FIG. 3, that corresponds to the onset of the actual clamped position, is reached. The position illustrated in FIG. 2 is reached subsequently. The second guide element 14 of the extension member 9 is already located on the curved guide track section 12.2 and is thus pivoted slightly to the right. Due to the fact that the control cam 6.1 already touches the contact surface 4.1, the inner shaft 2.1 is already pushed slightly downwards against the force of the resetting element 8. As further seen, it is no longer possible in these positions according to FIGS. 2 and 3 (self-locking effect) to move the clamping element 1 into the open position by applying a force on it, due to the position of the toggle lever mechanism.

To now be able to use the above-mentioned tolerance compensation according to the disclosure, the adjustment member 10 is now displaced even farther to the top of the housing 11 based on FIG. 2. Thus, the second guide element 14 moves even farther to the right on the curved guide track section 12.2. Thus, the intermediate member 6 is ultimately rotated clockwise even farther. This further rotation has the result that the control cam 6.1 pushes the adjustment element 4 even farther downwards against the force of the resetting element 8 in a linear movement direction. Thus, the clamping device according to the disclosure, as a whole, comprises the overall movement of the clamping element 1 during opening and closing includes an overlapped rotational and displacement movement.

The transition from the closed position (see FIG. 1) to the open position (see FIG. 5) is accordingly made in reverse order.

The motion sequence of the above-mentioned tabs 18, 19, which belong to the auxiliary mechanism for a manual operation, incidentally also results from FIGS. 1 to 5.

The present disclosure has been described with reference to the preferred embodiments. Obviously, modifications and alternations will occur to those of ordinary skill in the art upon reading and understanding the preceding detailed description. It is intended that the present disclosure be construed to include all such alternations and modifications insofar as they come within the scope of the appended claims or their equivalents.

What is claimed is:

1. A clamping device comprising:

a rotatably mounted clamping shaft, the clamping shaft is connected rotationally conjointly to a clamping element;

a control mechanism is operatively connected to the clamping shaft, the control mechanism converts a linear drive movement into a rotational movement of the clamping shaft;

the clamping shaft includes an inner shaft and an outer shaft, the outer shaft receives the inner shaft, the outer shaft is connected to the control mechanism, a lever arm is arranged on the outer shaft to pivot the clamping shaft;

the inner shaft is connected rotationally conjointly to the clamping element, the inner shaft is displaceably mounted in the outer shaft, but the inner shaft is mounted in a rotationally conjoint fashion radially within the outer shaft with respect to the main axis of rotation of the clamping shaft; and an adjustment element fixes the inner shaft in a position relative to the outer shaft, the adjustment element is operatively connected to the inner shaft.

2. The clamping device according to claim 1, wherein the adjustment element is formed as a cylindrical journal that is fixedly connected to the inner shaft, the cylindrical journal extends through a reach-through opening on the outer shaft and is operatively connected to the control mechanism.

3. The clamping device according to claim 2, wherein the lever arm is connected in an articulated fashion to an intermediate member and the journal, on its front side on its end which faces away from the inner shaft, includes a contact surface that interacts with a control cam arranged on the intermediate member.

4. The clamping device according to claim 3, wherein the intermediate member is connected to an extension member in an articulated fashion.

5. The clamping device according to claim 4, wherein the extension member is connected to a linearly movable adjustment member in an articulated fashion.

6. The clamping device according to claim 4, further comprising a first guide element interacting with a guide track on a clamp head housing and the first guide element arranged on the extension member-side end of the adjustment member.

7. The clamping device according to claim 6, further comprising a second guide element interacting with the guide track and arranged on the intermediate member-side end of the extension member.

8. The clamping device according to claim 1, further comprising a centering element, formed as a cylinder pin, oriented vertically to the main axis of rotation of the clamping shaft and arranged between the inner shaft and the outer shaft.

9. The clamping device according claim 8, wherein the centering element is fixedly connected to the inner shaft and is displaceably mounted in the outer shaft.

10. The clamping device according to claim 8, wherein the intermediate member is connected to an extension member in an articulated fashion.

11. The clamping device according to claim 1, further comprising a resetting element, such as a compression spring, arranged between the inner shaft and the outer shaft.

12. The clamping device according to claim 11, wherein the intermediate member is connected to an extension member in an articulated fashion.

* * * * *